US007674010B2

(12) United States Patent
Griffiths et al.

(10) Patent No.: US 7,674,010 B2
(45) Date of Patent: Mar. 9, 2010

(54) LIGHT FIXTURE HAVING LIGHT EMITTING DIODE (LED) AND RESILIENT MEMBER

(75) Inventors: Terence Paul Griffiths, Tilford (GB); Robert Griffiths, Tilford (GB)

(73) Assignee: Hogarth Fine Art Limited, Surrey (GB)

( * ) Notice: Subject to any disclaimer, the term of this patent is extended or adjusted under 35 U.S.C. 154(b) by 0 days.

(21) Appl. No.: 11/903,243

(22) Filed: Sep. 21, 2007

(65) Prior Publication Data

US 2008/0106892 A1 May 8, 2008

(51) Int. Cl.
*F21S 4/00* (2006.01)

(52) U.S. Cl. ..... 362/249.02; 362/240; 362/285

(58) Field of Classification Search ..... 362/240, 362/648, 250, 372, 555, 285, 485; 439/110; 361/719

See application file for complete search history.

(56) References Cited

U.S. PATENT DOCUMENTS 3,474,381 A * 10/1969 Baldwin ..... 439/36
3,718,816 A * 2/1973 Seelbach et al. ..... 362/394
4,471,415 A * 9/1984 Larson et al. ..... 362/250
4,628,421 A * 12/1986 Saar ..... 362/238
4,821,162 A 4/1989 Ellis
4,845,601 A * 7/1989 Podbury et al. ..... 362/125
4,859,057 A * 8/1989 Taylor et al. ..... 600/473
4,999,755 A * 3/1991 Lin ..... 362/250
5,050,047 A * 9/1991 Viner et al. ..... 362/552
5,194,725 A * 3/1993 Sawase et al. ..... 250/208.1
5,222,799 A * 6/1993 Sears et al. ..... 362/146
5,599,086 A * 2/1997 Dutta ..... 362/490
6,157,117 A * 12/2000 Taylor ..... 313/318.01
6,361,186 B1 3/2002 Slayden
6,578,979 B2 * 6/2003 Truttmann-Battig ..... 362/92
6,582,103 B1 * 6/2003 Popovich et al. ..... 362/307
6,585,393 B1 * 7/2003 Brandes et al. ..... 362/249
6,612,717 B2 * 9/2003 Yen ..... 362/245
6,726,348 B2 * 4/2004 Gloisten ..... 362/372
7,033,060 B2 * 4/2006 Dubuc ..... 362/600
7,101,056 B2 * 9/2006 Pare ..... 362/190
7,170,751 B2 * 1/2007 Mayer ..... 361/719
7,331,689 B2 * 2/2008 Chen ..... 362/240

(Continued)

FOREIGN PATENT DOCUMENTS

EP 0669492 8/1995

(Continued)

OTHER PUBLICATIONS

International Search Report from Application GB0618577.1 dated Jan. 12, 2007.

(Continued)

*Primary Examiner*—Gunyoung T Lee
(74) *Attorney, Agent, or Firm*—Carter, DeLuca, Farrell & Schmidt, LP

(57) ABSTRACT

A housing for a light fixture, and the light itself, is disclosed. The housing comprises an elongate body and a resilient member mountable in the body to retain at least one light emitting diode (LED) between the resilient member and the housing such that the or each LED is repositionable within the housing. The light includes at least one LED mounted in the housing.

19 Claims, 16 Drawing Sheets

U.S. PATENT DOCUMENTS

| | | | |
|---|---|---|---|
| 2002/0044456 | A1 | 4/2002 | Balestriero et al. |
| 2005/0007778 | A1 | 1/2005 | Lin |
| 2006/0146531 | A1 | 7/2006 | Reo et al. |

FOREIGN PATENT DOCUMENTS

| | | |
|---|---|---|
| GB | 2 420 613 | 5/2006 |
| JP | 1-276505 | 11/1989 |

OTHER PUBLICATIONS

United Kingdom Examination Report for Application Serial No. GB 0618577.1, issued Oct. 1, 2009; 4 pages.

* cited by examiner

LIGHT FIXTURE HAVING LIGHT EMITTING DIODE (LED) AND RESILIENT MEMBER

CROSS-REFERENCE TO RELATED APPLICATION

The present application claims the benefit of and priority to United Kingdom Application Serial No. 0618577.1, filed on Sep. 21, 2006, the entire content of which is incorporated herein by reference.

BACKGROUND

1. Technical Field

The present invention relates to a light fixture. In particular, the invention relates to a housing for a light fixture capable of retaining at least one light emitting diode (LED) therein for illuminating paintings or other surfaces.

2. Background of Related Art

Lights for illuminating pictures and the like are in widespread use and generally comprise one or more light bulbs received in an electrical socket mounted in an elongate shade or hood. Such lights are generally mounted by means of a tubular support arm, one end of which is attached to the shade by a swivel or pivot joint, whilst the opposite end of the arm has a fitting for mounting the light to a picture frame or on a wall. An electrical wire extends through the arm from a connector in the fitting to supply power to the light bulbs from a mains source or battery pack. The pivot or swivel joint allows the angle of the shade to be adjusted relative to the support arm to enable the direction of the beam of light to be controlled to, for example, illuminate a picture.

A problem with conventional lights for illuminating pictures and the like is their ability to supply uniform lighting across a required width or region, such as the whole of a picture being illuminated. Conventional lights usually have an elongate shade, which is much shorter than the width of the picture or area to be illuminated and so the intensity of the pool of light tends to weaken towards the edges of the picture. Although attempts have been made available which try to alleviate this problem by, for example, providing light deflectors or baffles mounted in the shade to re-direct the light, the design of such conventional lights is complicated and the light is still not of sufficiently uniform intensity across the whole width of the picture. Although larger shades may house multiple light bulbs in respective sockets, the sockets themselves are in fixed positions and do not enable precise adjustment of the light being generated.

A further disadvantage with conventional bulbs is that they produce a large amount of heat that could potentially damage an illuminated painting.

In several applications, light emitting diodes (LEDs) are replacing conventional light bulbs. They are particularly suitable for use in lighting a picture or the like as they consume less power and produce a limited amount of heat.

The present invention seeks to provide a light or light fixture, and a housing for a light or light fixture, that overcomes or substantially alleviates the problems of those discussed above and, in particular, to provide a more versatile light that can be adjusted to provide more uniform illumination over a given area.

SUMMARY

According to the present invention, there is provided a housing for a light fixture comprising an elongate body and a resilient member mountable in the body to retain at least one light emitting diode (LED) between the resilient member and the housing such that the or each LED is repositionable within the housing.

Preferably, the housing comprises a channel having a base to define an LED supporting surface, the resilient member being configured so that the or each LED is held against the supporting surface by the resilient member.

The resilient member may be configured so that the or each LED held against the supporting surface is independently slideable along the supporting surface.

In a preferred embodiment the housing comprises a pair of slots in the channel on opposite sides of the LED supporting surface and a resilient member removably received in a respective slot.

In one embodiment, each resilient member comprises a rail, the rails in respective slots being parallel and spaced from each other.

The rails may be electrically conductive so as to contact electrical terminals on the or each LED on the LED supporting surface to supply power thereto.

Each resilient member conveniently has a base slidably received in said slot and, an arm extending into said channel and towards the LED supporting surface from said base.

Preferably, the arm of each resilient member is configured so that, when one or more LEDs are positioned on the LED supporting surface, the arm is resiliently deformed by the LED to hold said LED against said LED supporting surface.

Advantageously the elongate body has a uniform cross-section at any point along its length so that it may be cut to any desired length prior to use.

Preferably, the housing according to any preceding claim comprises a pair end caps attachable to each end of the elongate body.

At least one end cap may be removable to enable one or more LEDs to be slid into the channel between the resilient members and the LED supporting surface, or removed therefrom.

The housing advantageously includes a plurality of fins formed on the housing to dissipate heat generated by the or each LED.

In one embodiment the housing comprises a pair of arms to support the housing.

Preferably, the housing comprises a pair of resilient tracks configured to be resiliently biased towards the arms at one end so as to contact the arms, the resilient tracks contacting the pair of rails at the other end, wherein the arms and the resilient track are electrically conductive so as to contact the arms to the rails to supply power thereto.

The housing may further comprise a switch, wherein the switch is actionable to contact one of the resilient tracks and move said resilient track away from one of the arms so as to break the electrical contact between said resilient track and arm.

Preferably, the housing includes a diffuser slideably mounted in the body to diffuse light generated by the or each LED.

In a preferred embodiment the housing comprises a reflective material mounted in the channel such that the or each LED is extendable therethrough to reflect light generated by the or each LED.

A light may include a housing and at least one LED held against the LED supporting surface by the resilient member.

Preferably the light comprises a plurality of LEDs held against the LED supporting surface by the resilient members, each LED being discrete and independently movable relative to each of the remaining LEDs.

In one embodiment, the or each LED comprises an light emitting portion and a supporting plate, the resilient members acting against the supporting plate to retain the LED against the LED supporting surface.

The or each LED may have electrical terminals formed on the supporting plate and the resilient members are may be configured so that they lie in contact with said electrical terminals when said LEDs are positioned against the LED supporting surface.

DETAILED DESCRIPTION OF THE DRAWINGS

Embodiments of the present invention will now be described, by way of example only, with reference to the accompanying drawings, in which.

DETAILED DESCRIPTION OF EMBODIMENTS

Figure 1:
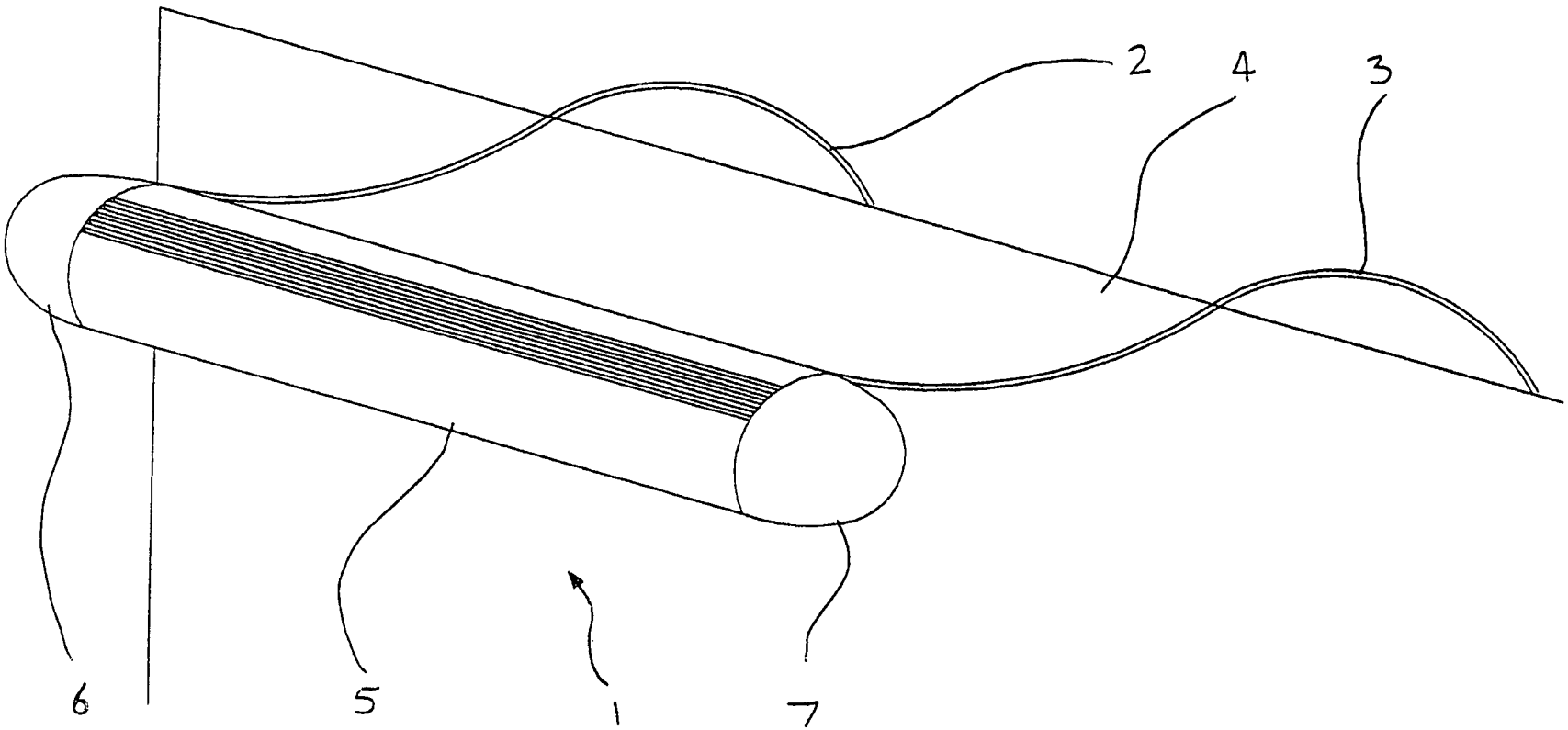
FIG. 1 is an elevated perspective view of a light fixture in accordance with an embodiment of the present invention mounted for use in illuminating a picture.
Figure 7:
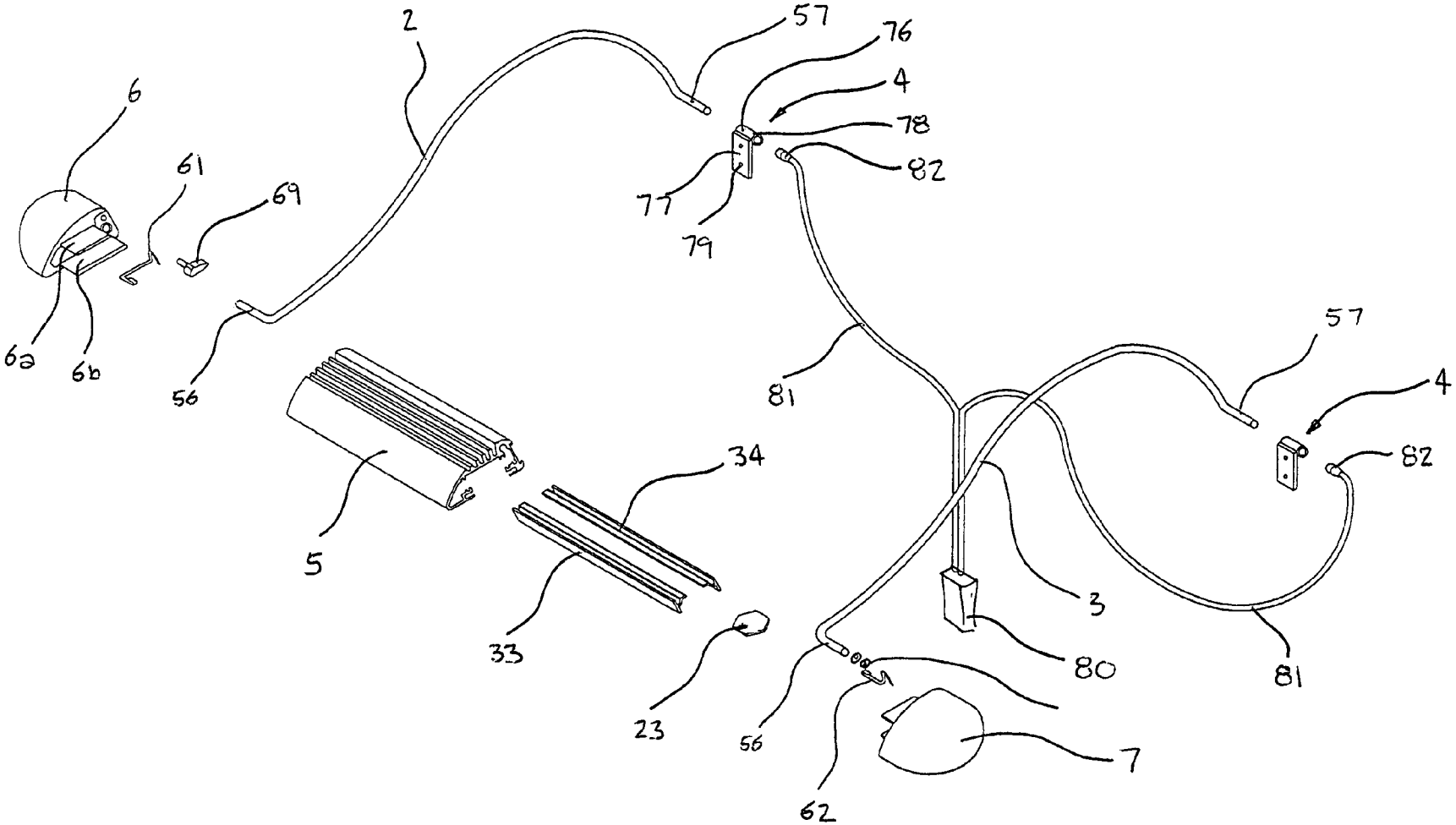
FIG. 7 is an exploded perspective view of the light fixture shown in FIG. 1.

Referring now to the drawings, there is shown in FIG. 1 a light fixture 1 according to an embodiment of the present invention, attached to arms 2, 3 which may be mounted to a picture frame (not shown) or the like by means of mounting brackets 4 (see FIG. 7). The light fixture 1 comprises an elongate housing 5 and first and second end caps 6, 7 fixed to first and second ends 5*a*, 5*b* of the elongate housing 5 by means of first and second flange portions 6*a*, 6*b*, 7*a*, 7*b* (see FIG. 8) extending from first and second caps 6, 7 and which locate in first and second ends 5*a* and 5*b* of the elongate housing 5 respectively, as will be explained hereinafter. Further, each arm 2, 3 is mounted to a respective end cap 6, 7.

Figure 2:
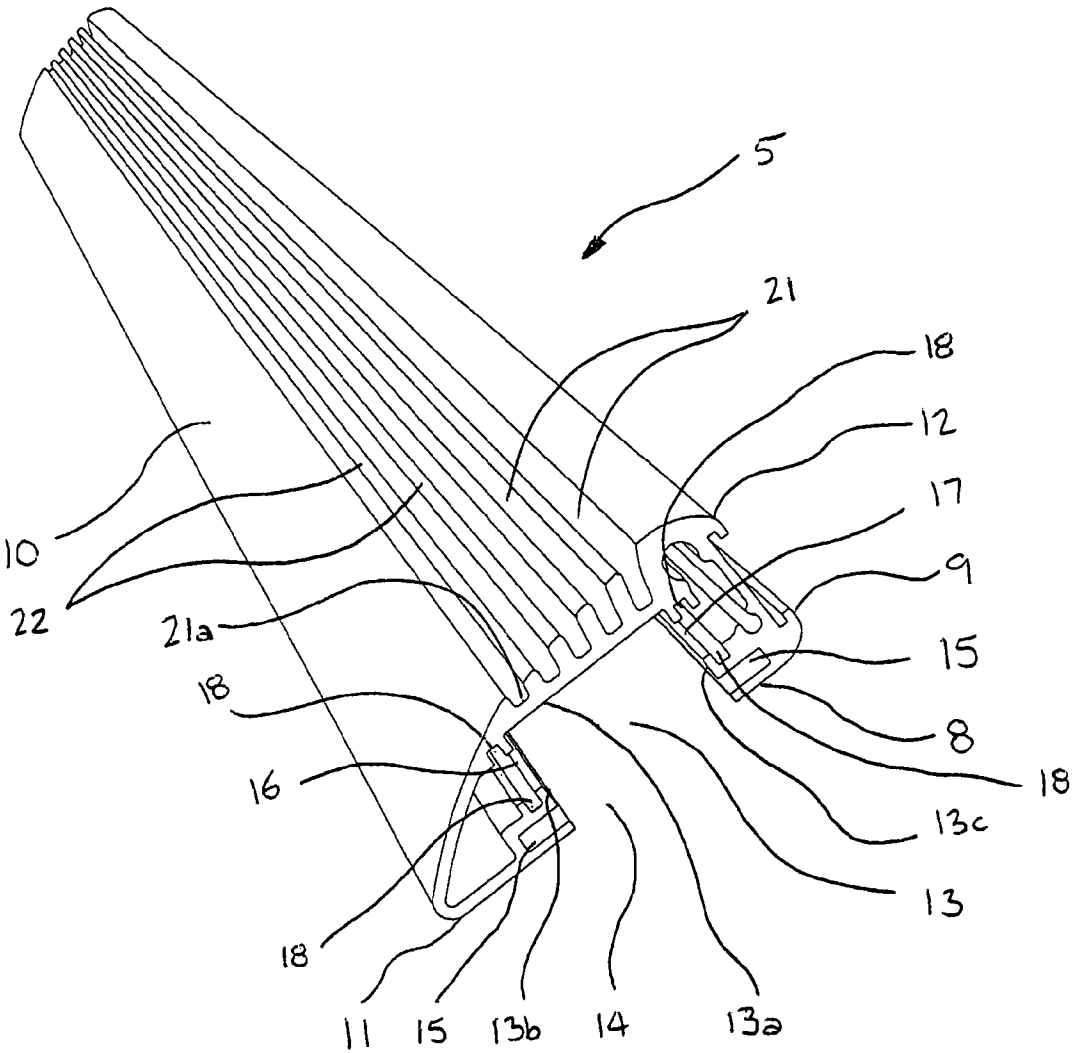
FIG. 2 is a perspective view from above of the elongate housing of the light fixture shown in FIG. 1.
Figure 3:
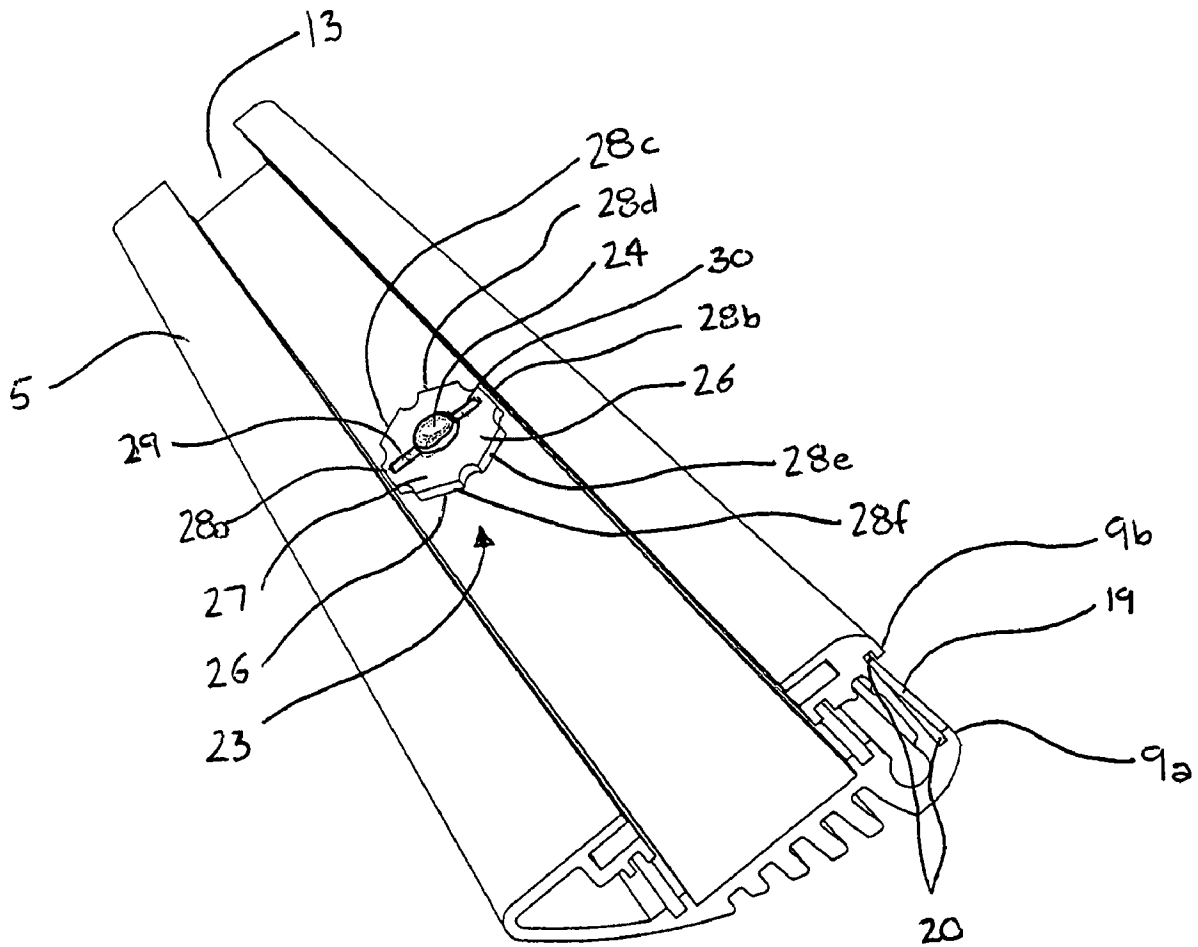
FIG. 3 is a perspective view from below of the elongate housing shown in FIG. 2 with an LED disposed therein.
Figure 4:
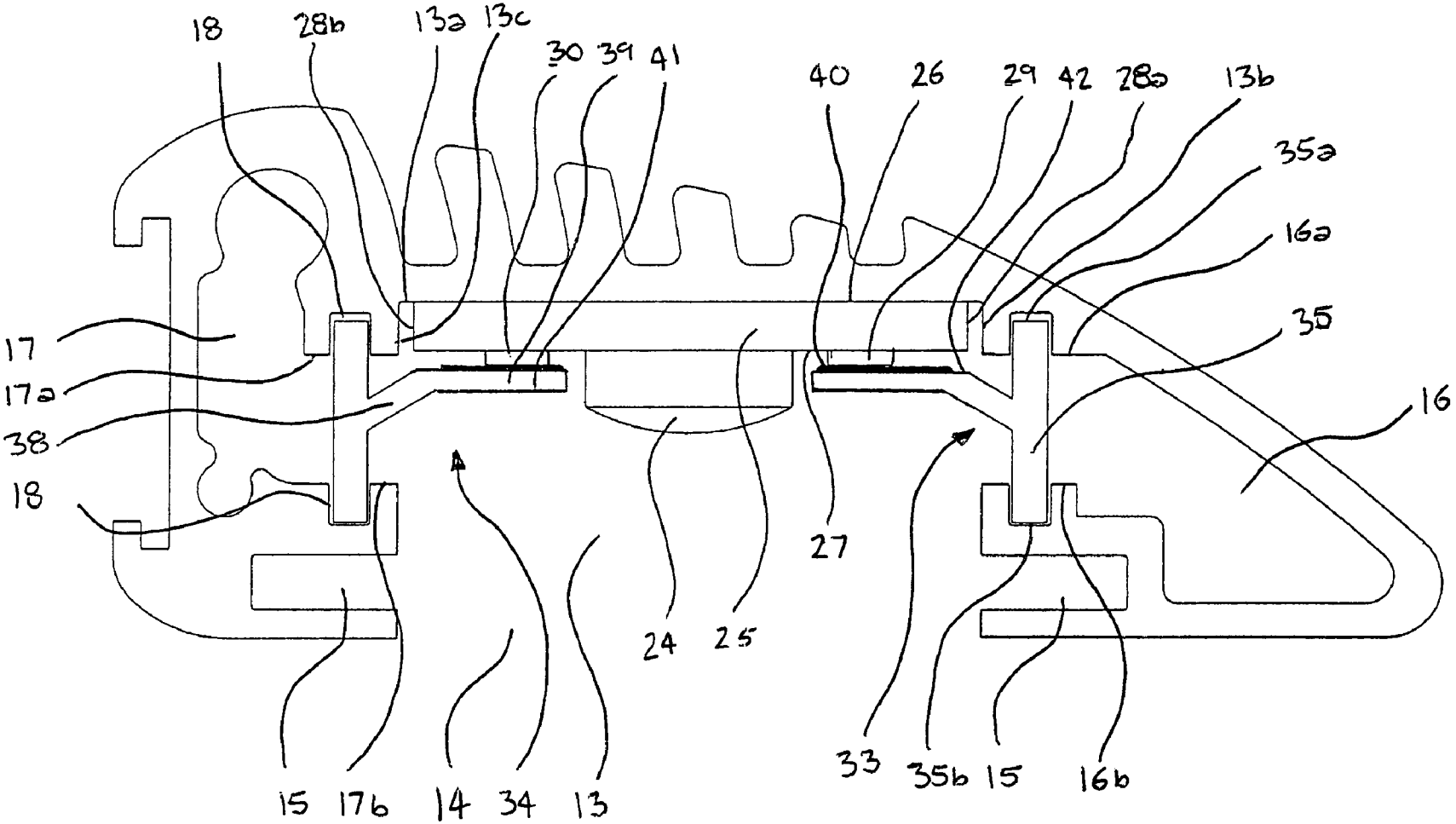
FIG. 4 is a cross sectional view of the elongate housing shown in FIG. 3 with resilient members therein.

Referring to FIGS. 2 to 4, it can be seen that the elongate housing 5 has a uniform cross section which is defined by lower and rear faces 8, 9 which are perpendicular to each other. An arcuately shaped upper face 10 is formed between the respective distal ends 11, 12 of the lower and rear faces 8, 9 such that the shape of the housing 5 is defined and the junction between each face 8, 9, 10 is rounded. It will be appreciated that alternative shapes may be used for the housing 5 dependent on the desired aesthetic appearance.

A channel 13 is formed in the elongate housing 5 and extends along the length of the housing 5. The channel 13 has an opening 14 in the lower face 8 of the housing 5 and is comprised of a channel base 13*a* parallel to the lower face 8 and two opposing channel sides 13*b*, 13*c* formed perpendicular to the channel base 13*a*. First slots 15 are formed on opposing sides 13*b*, 13*c* of the channel 13 proximate to the channel opening 14 and extend parallel to the lower face 8. Opposing front and rear recessed regions 16, 17 are formed in each channel side 13*b*, 13*c* between the first slots 15 and the base 13*a*. Located adjacent to each recessed region 16,17 communicating with the channel 13 are second slots 18 formed on opposing sides 16*a*, 16*b*, 17*a*, 17*b* of each recessed region 16, 17 respectively.

The elongate housing also comprises a rear recess 19 formed in the rear face 9. Portions 9*a*, 9*b* of the rear face 9 overhang the rear recess 19 to define opposing rear slots 20. Further, a number of grooves 21 are formed in the upper face 10 to define a number of fins 22 disposed above the channel 13. Each groove 21 extends into the housing 5 such that there is a thin wall remaining between a base 21*a* of each groove 21 and the channel base 13*a*. Each fin 22 is slightly arcuate in shape. The elongate housing 5 may be formed from extruded metal or plastic material and, because the housing 5 has a uniform or constant cross-section, it may be cut to any required length prior to attachment of the end caps 6,7.

Figure 5:
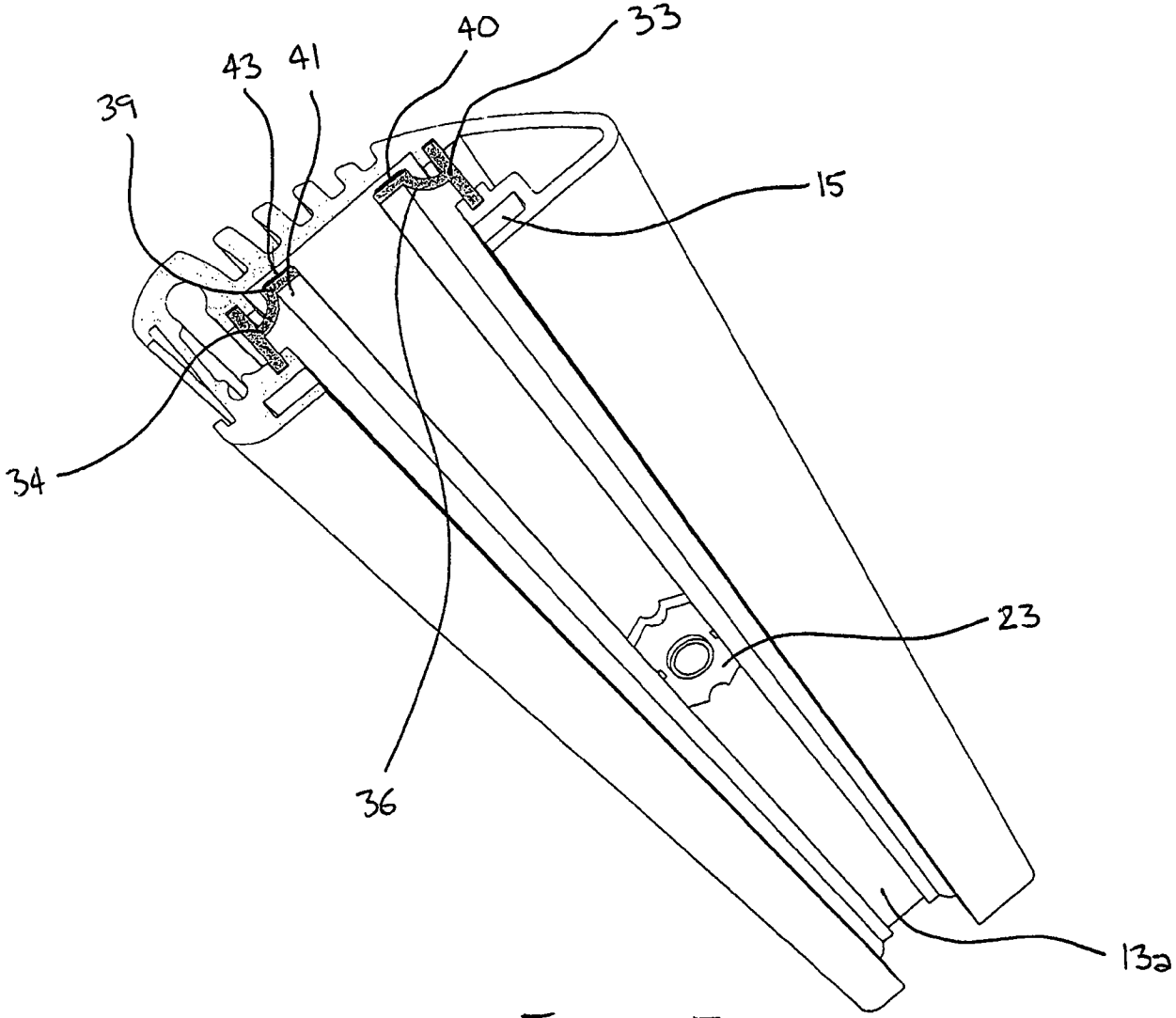
FIG. 5 is another perspective view from below of the elongate housing shown in FIG. 4 with the resilient members therein.

A plurality of individual or discrete light emitting diode (LED) assemblies 23 are located in the channel 13 as shown in FIGS. 3 to 6 (only one LED is shown in FIGS. 3 and 5). The LED assembly 23 comprises a light emitting diode (LED) 24 disposed centrally on an LED mounting plate 25. The LED 25 is a white light producing LED although it will be understood that alternative colour producing LEDs may be used, if required. The LED mounting plate 25 is formed from a heat conductive material such as aluminium, comprising opposing upper and lower planar faces 26, 27 and side surfaces 28*a*, 28*b*, 28*c*, 28*d*, 28*e*, 28*f* each separated by facets. Electrical terminals 29, 30 are mounted on the lower face 26 of the LED mounting plate 25 such that they are slightly upstanding therefrom, and located relative to the LED 24 such that they electrically communicate therewith to define positive and negative electrical terminals 29, 30 respectively. The electrical terminals 29, 30 extend in opposing directions from the LED 24 along the lower face 27 of the LED mounting plate 25 towards two opposing side surfaces, for example, 28*a*, 28*b* respectively.

The LED assembly 23 is disposed in the channel 13 of the elongate housing 5 such that the upper planar face 29 is disposed against the channel base 13*a* and is slidable thereabout. Further, the two side surfaces 28*a*, 28*b* proximate to the electrical terminals 29, are located against the channel sides 13*b*, 13*c* to prevent rotation of the LED mounting plate 25 relative to the housing 5 as will be explained below.

Figure 6:
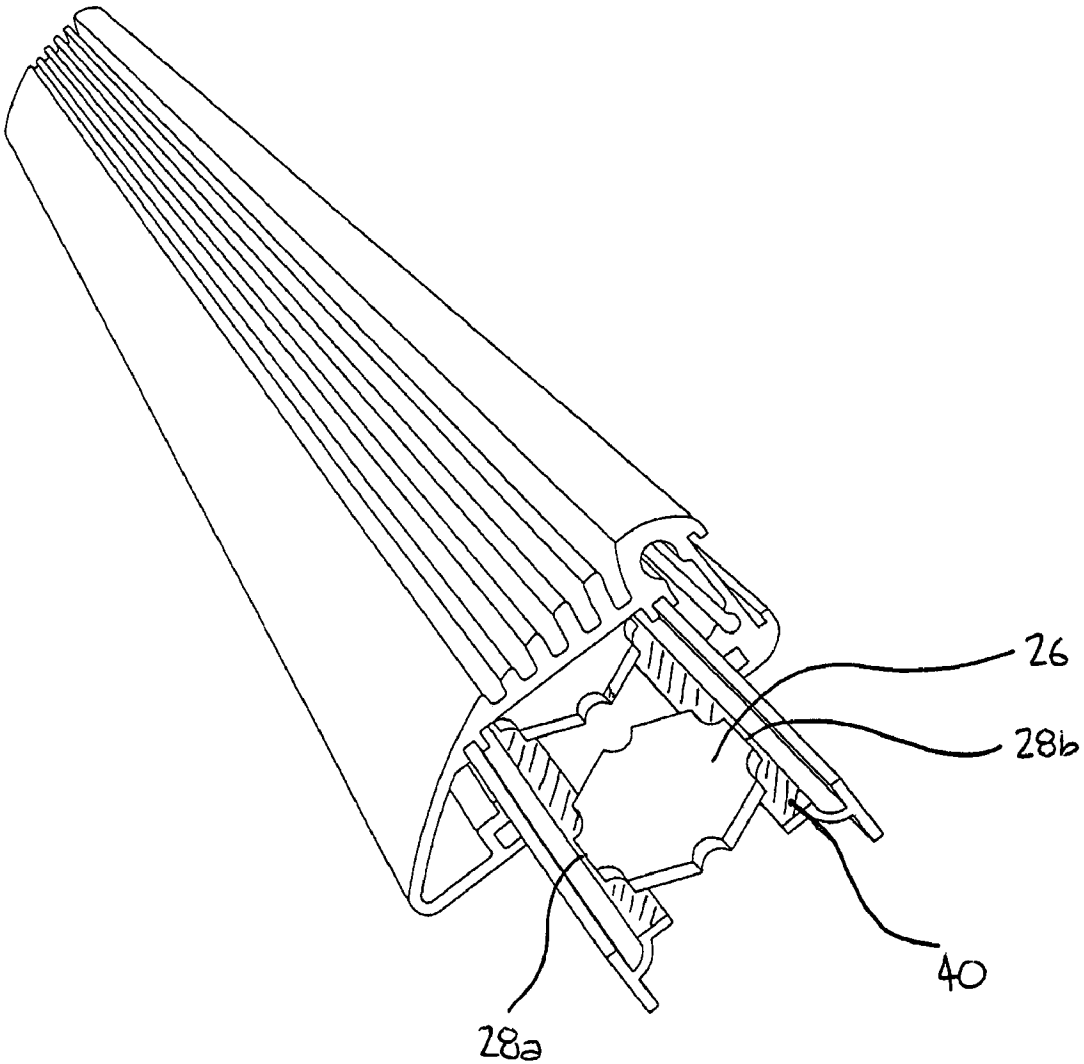
FIG. 6 is another perspective view from above of the elongate housing shown in FIG. 4 with the resilient members partially slid out of the housing together with an LED therebetween.

First and second elongate resilient members 33, 34 are shown in FIGS. 4 to 6 and each member 33, 34 comprises a base portion 35 with a pair of ends 35*a*, 35*b* and an arm 36 upstanding from midway along a front face 37 of the base portion 35. Each arm 37 comprises first and second arm portions 38, 39, the first arm portion 38 extending obliquely upwards from the base portion 35 to communicate at a distal end with a lower face 41 of the second arm portion 39. The second arm portion 39 extends perpendicularly to the base portion 36 from the first arm portion 38 and an electrically conductive foil strip 40 is mounted along the longitudinal length of an upper face 42 of the second arm portion 39. The resilient members 33, 34 may be formed from a resilient plastic material or the like. In an alternative embodiment the resilient members 33, 34 may be formed from a conductive material, such as copper. In which case, the housing 5 is formed from a non-conductive material.

The first resilient member 33 is slidably received in the elongate housing 5 with the ends 36*a*, 36*b* of the base portion 36 extending into the respective second slots 18 formed in the sides 16*a*, 16*b* of the front recessed region 16 such that the arm 37 extends into the channel 13 and the conductive foil strip 40 opposes the channel base 13*a*. Similarly, the second resilient member 34 is received in the elongate housing 5 in the second slots 18 formed in the sides 17*a*, 17*b* of the rear recessed region 17 such that the arm 37 extends into the channel 13 and the conductive foil strip 40 opposes the channel base 13*a*. The gap 43 formed between the foil strip 40 and the base of the channel 13*a* is slightly less than the width of the LED mounting plate 25 such that the mounting plate 25 of each LED(s) assembly 23 disposed in the channel 13 is resiliently held between the channel base 13*a* and each upper face 42 of the first and second resilient members 33, 34 as will be explained in more detail below.

First and second end caps 6, 7 are shown in FIGS. 7 to 10 and each comprise a first end 44 and a second end 45, wherein the first end 45 is defined by a curved or contoured outer end surface. The second end 45 has a substantially planar face to correspond to the first end 5*a* of the elongate housing 5 and outer dimensions in cross section corresponding to the elongate housing 5 wherein planar lower and rear faces 46, 47 and an arcuate upper face 48 correspond to the lower, upper and arcuate faces 8, 9, 10 of the housing 5 respectively.

Referring now to the first end cap 6, first and second parallel flange portions 6*a*, 6*b* extend from the second end 45 parallel to the lower face 46. A stepped recess 49 is formed in the first end cap 6 between the first and second flange portions 6*a*, 6*b* such that the recess 49 is open along a portion of the lower and rear faces 46, 47. A rear section of the recess 49 extends to an inner face 50, and the front portion 51 of the recess 49 extends into the first end cap 6 such that the first end cap 6 is substantially hollow. A large cylindrical recess 52 is formed in the stepped portion 50 and a further smaller cylindrical recess 53 is formed in the stepped portion 50 above the large cylindrical recess 52 for reasons which will become apparent below. The second end cap 7 is substantially a mirror image of the first end cap 6, with first and second parallel flange portions 7*a*, 7*b*. However, the small cylindrical recess 52 is not formed therein.

With reference to FIG. 7, first and second arms 2, 3 are a pair of cylindrical rods which are uniform in length and cross sectional shape. Each rod has first and second end portions 56, 57 which are parallel to each other and the distance between the central axes of first and second end portions 56, 57 of arm 2 is equal to distance between the central axes of first and second end portions 56, 57 of arm 3. The first portions 56 of the first and second arms are disposed in opposite directions to each other for reasons which will become apparent below. The arms 2, 3 are formed of an electrically conductive material. A plurality of O-rings 58 are mounted circumferentially around the first portions 56 of first and second arms 2, 3. The first portion 56 of each arm 2, 3 is received within the large cylindrical recess 52 of each end cap 6, 7 such that the O-rings 58 firmly contact the inner surface 59 of each large cylindrical recess 52.

The first end cap 6 is mounted to the first end 5*a* of the housing 5 with first and second flange portions 6*a*, 6*b* extending into and locating in the housing 5. The first flange portion 6*a* corresponds to the width of the channel 13 and is slidably received therein such that it is resiliently held between the channel base 13*a* and the upper faces 42 of the first and second elongate resilient members 33, 34. The second flange portion 6*b* corresponds to the dimensions of the first slots 15 and is seated therein. Similarly, the second end cap 7 is mounted to a second end 5*b* of the housing 5 with first and second flange portions 7*a*, 7*b* extending into the housing 5. The first flange portion 7*a* corresponds to the width of the channel 13 such that it is resiliently held between the channel base 13*a* and the upper face 42 of the pair of elongate resilient members 34 and the second flange portion 7*b* corresponds to the dimensions of the first slots 15 and is seated therein.

Figure 11:
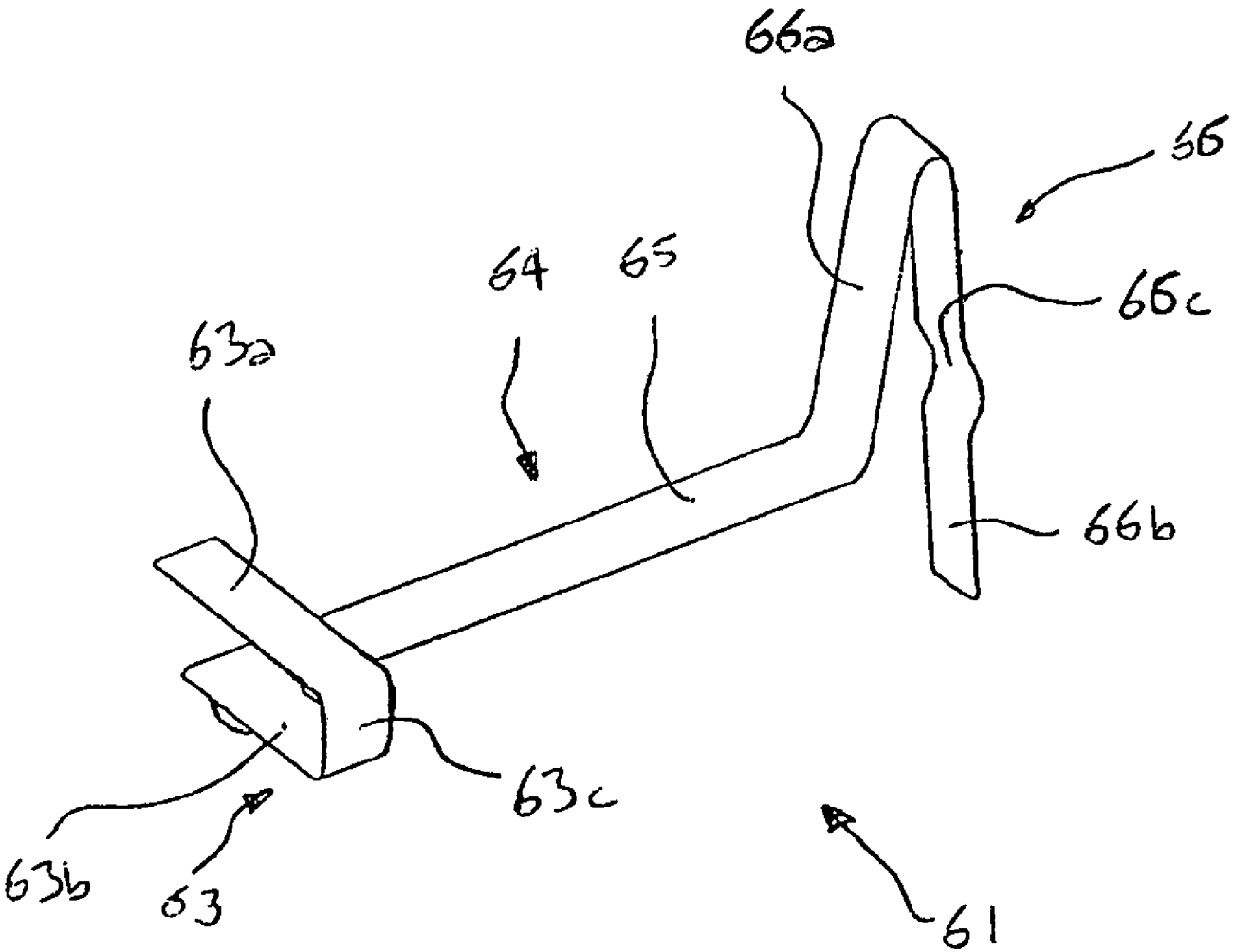
FIG. 11 is a perspective view of a first conductive track forming part of the switch mechanism of the light fixture shown in FIG. 1.
Figure 12:
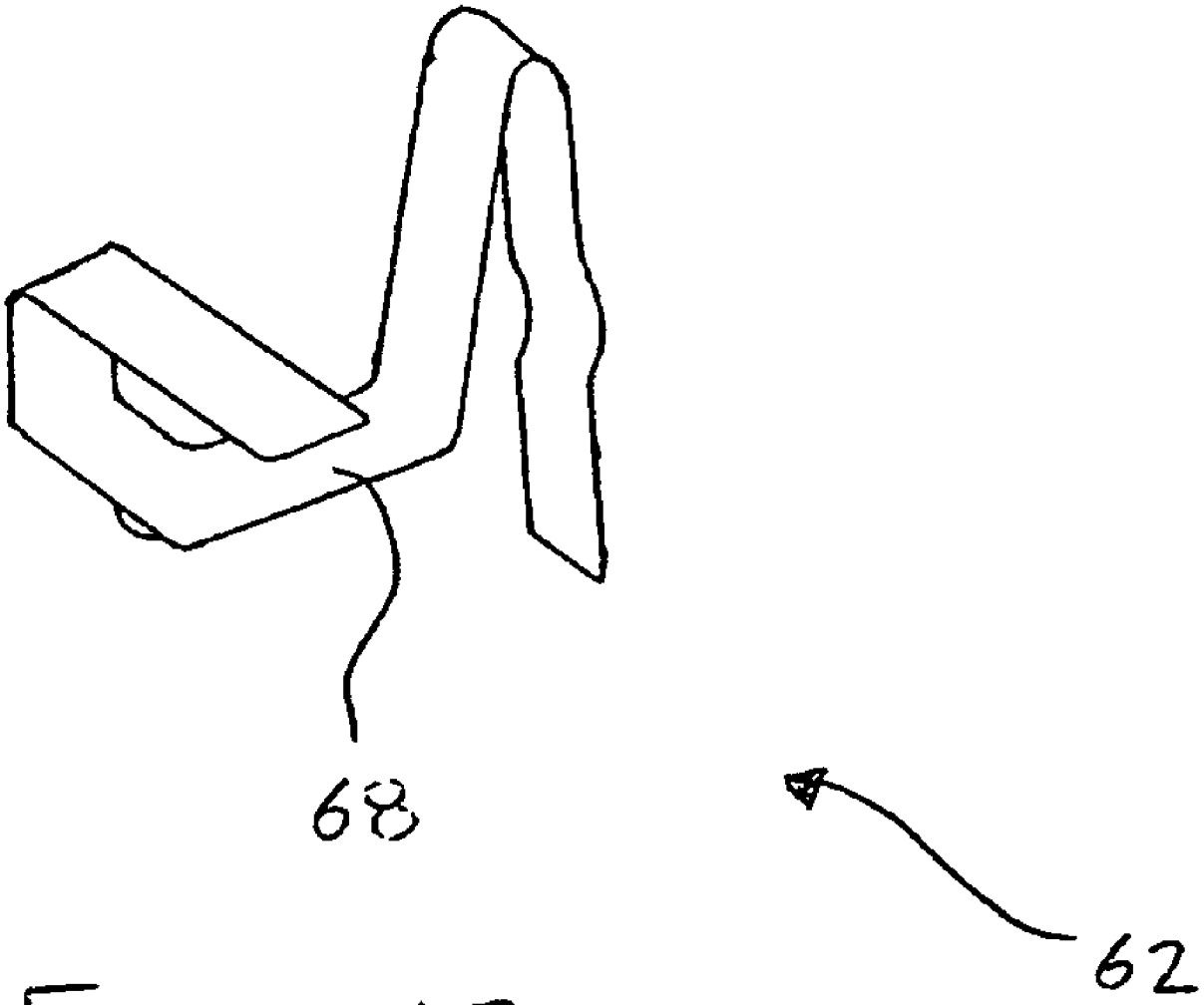
FIG. 12 is a perspective view of a second conductive track forming part of the switch mechanism of the light fixture shown in FIG. 1.
Figure 13:
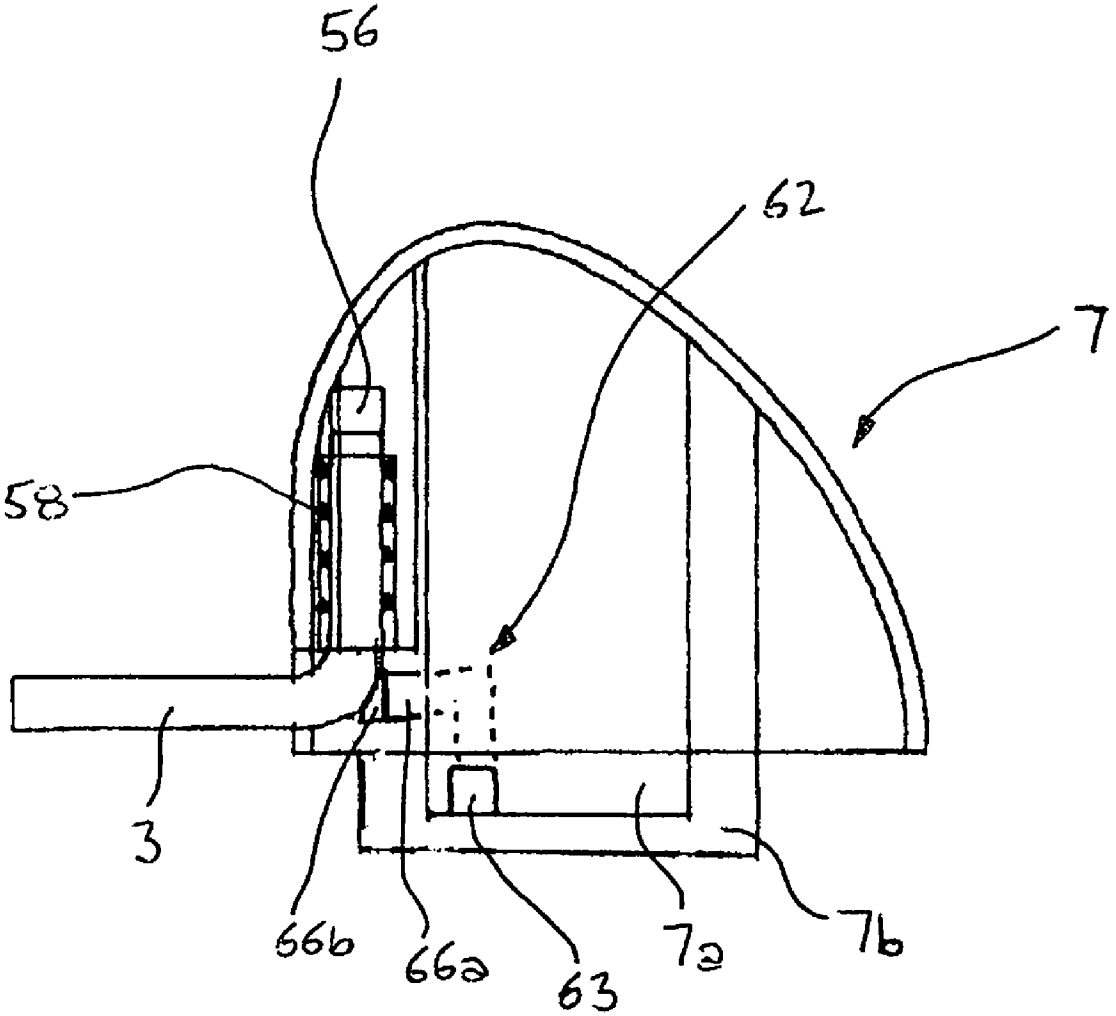
FIG. 13 is a plan view of the second end cap shown in FIG. 10 with the second conductive track of FIG. 12 disposed thereon.

A conductive track system 60 for electrically communicating first and second arms 2, 3 to first and second resilient members 33, 34 respectively is shown in FIGS. 11 to 13 and comprises first and second contact tracks 61, 62. The first contact track 61 is formed from an L-shaped resilient conductive metal strip, such as copper wherein a first side 63 is 'U'-shaped with an upper length 63*a* running parallel to a lower length 63*b* and perpendicular length 63*c* formed between the upper and lower lengths 63*a* 63*b*. A raised portion 67 is formed on a lower side 63*d* of the lower length 63*b*. The second side 64 comprises a connecting portion 65 with a spring portion 66 at a distal end to the first side 63, wherein the spring portion 66 is formed such that a first length 66*a* extends substantially perpendicularly upwards to the connecting portion 65 and a second length 66*b* extends obliquely downwards from the distal end of the first length 66*a* to form a 'V' shape. A notch 66*c* is formed approximately midway along the second length 66*b* of the spring portion 66 extending away from the first portion to form a raised area. The second contact track 62 is substantially a mirror image of the first contact track 61, however the connecting portion 68 of the second contact track 62 is shorter than the connecting portion 65 of the first contact track 61 for reasons which will become apparent below.

The light of the present invention also includes a switch 69 comprising a lever portion 70 and pivot 71. The pivot 71 is cylindrical and extends perpendicularly from midway along the lever portion. The lever portion 70 has a shoulder 72 at a first end and is rounded at the second end 73 distal to the shoulder 73.

The U-shaped portion 63 of the first contact track 61 is mounted around the distal end 74 of the second flange portion 6*b* of the first end cap 6 such that the perpendicular length 63*c* abuts it and upper and lower lengths 63*a*, 63*b* extend along the upper and lower surfaces of the second flange portion 6*b* parallel to the location of the first resilient member 33 when the first end cap 6 is attached to the first end 5*a* of the housing 5 such that the raised portion 67 of the first conductive track 61 contacts the foil strip 40. The lower length 63*b* extends such that the connecting portion 65 extends into the end cap recess 49 and lies proximate to the inner face 50 of the recess 49. The second length 66*b* of the spring portion 66 is then aligned to contact the first arm 2 disposed in the first end cap 6.

Similarly the second conductive track 62 is mounted to the second end cap 7 such that the raised portion 67 of the second conductive track 62 contacts the foil strip 40 of the second resilient member 34 and the second length 66*b* of the spring portion 66 is then aligned to contact the second arm 3 disposed in the second end cap 7.

The hinge portion 71 of the switch 69 is rotatably disposed in the small cylindrical recess 53 in the first end cap 6 such that the shoulder portion 70 extends out of the rear opening of the end cap recess 49. The second end 73 is therefore disposed to contact the notch 66*c* on the second length 66*b* of the spring portion 66 of the first conductive track 61.

The pair of mounting brackets 4 are disclosed in FIG. 7 and comprise a tube 76 and a plate 77 fixedly mounted at a tangent to the outer surface 78 of the tube 76. A pair of screw holes 79 are formed through the plate 77 to receive mounting screws or the like (not shown). Further, a transformer 80 is shown with a pair of wires 81 extending therefrom. Each wire 81 has a connector 82 attached to it at the distal ends to the transformer 80.

Each mounting bracket 4 is slidably fitted over the second end portions 57 of the first and second arms 2, 3 such that a section of each end portion 57 extends through the tube 76. The connectors 82 are then each attached to each end portion 57 such that the wires 81 electrically communicate therewith.

Figure 14:
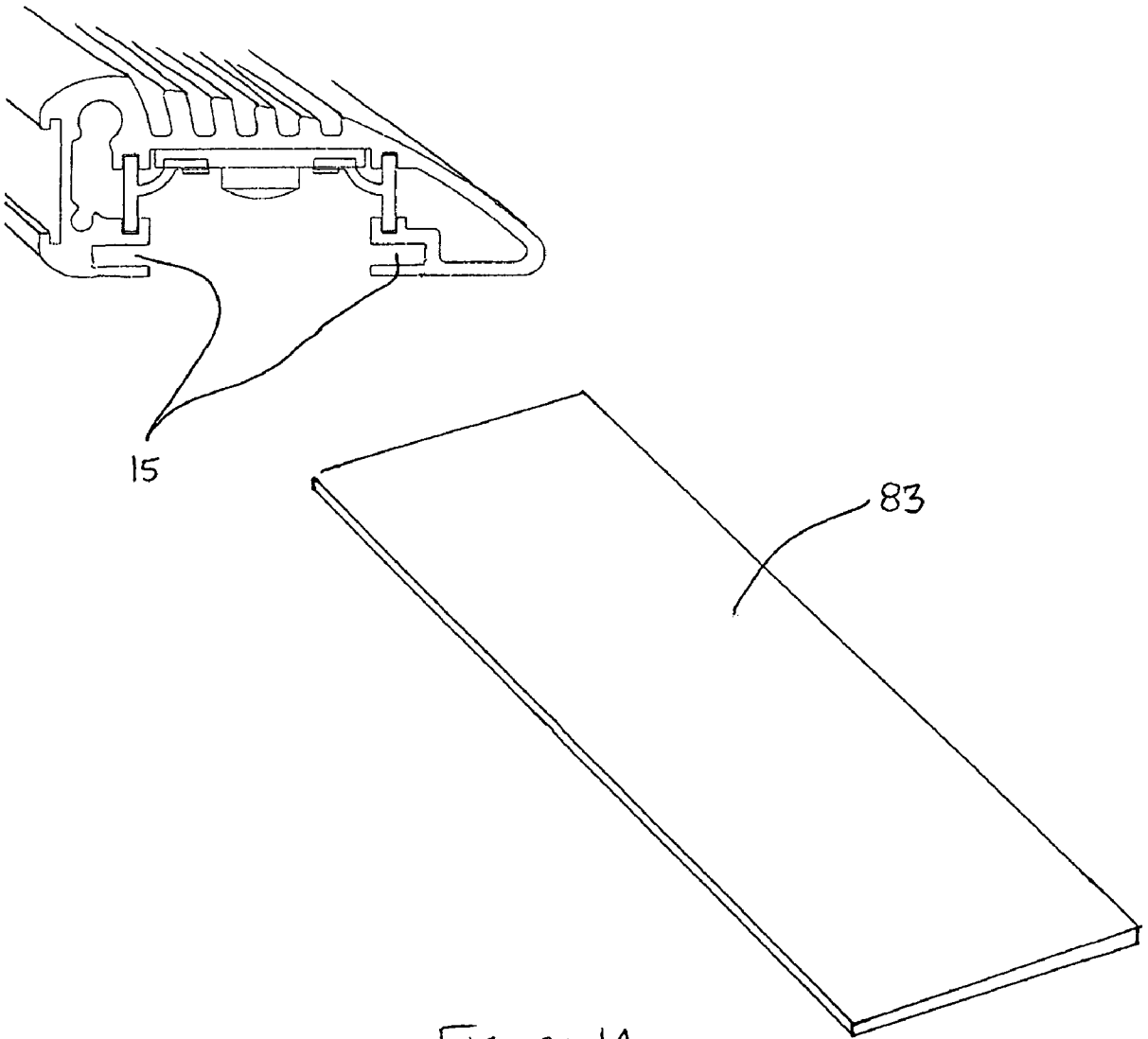
FIG. 14 is a perspective view of the elongate housing shown in FIG. 4 to show how a diffuser may be attached thereto.

A diffuser 83 for diffusing light generated by the LED 25 is shown in FIG. 14. The diffuser 83 comprises a translucent plate which may be seated in the laterally extending first slots 15 such that it extending substantially along the length of the housing 5.

Figure 15:
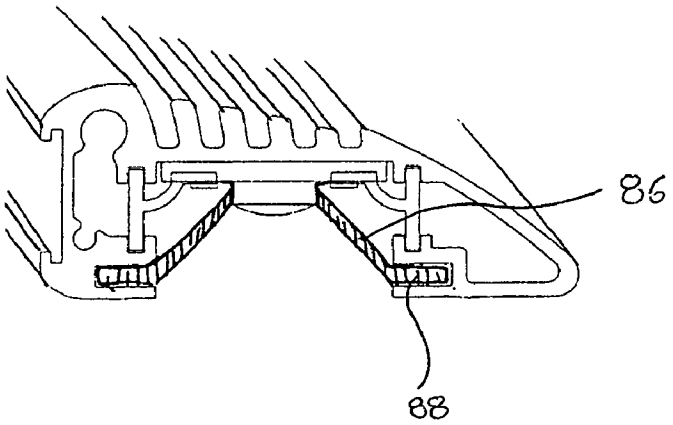
FIG. 15 is a perspective view of the elongate housing shown in FIG. 6 to show how a reflector may be attached thereto.
Figure 15:
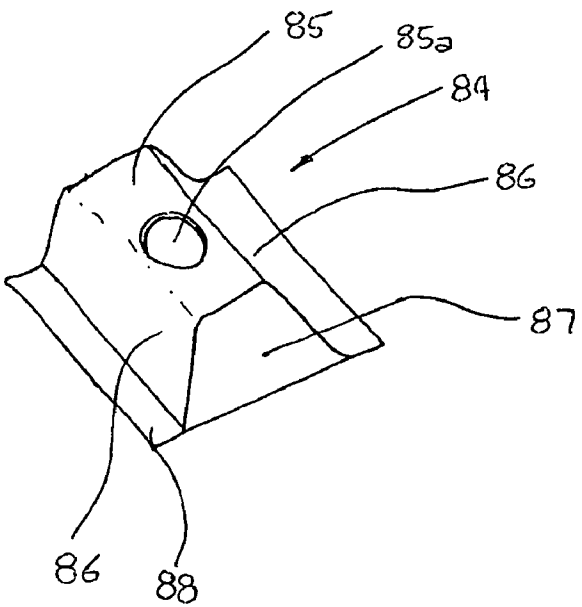

A reflector 84 for the LED 25 is shown in FIG. 15. The reflector 84 comprises a base portion 85 with an aperture 85*a* formed therethrough to receive an LED 25 such that it extends through the aperture 85*a* and side walls 86, 87 extending from each side of the base portion 85. Two of the side walls 86 extend at an oblique angle to the base portion 85 and two side walls 87 extend perpendicular thereto to form a hollow. The reflector 85 may be made from a plastic material wherein the internal walls are chrome plated to reflect light. Extending from the opposite end of each of the oblique walls 86 to the base portion 85, parallel thereto is an edge portion 88.

Figure 16A:
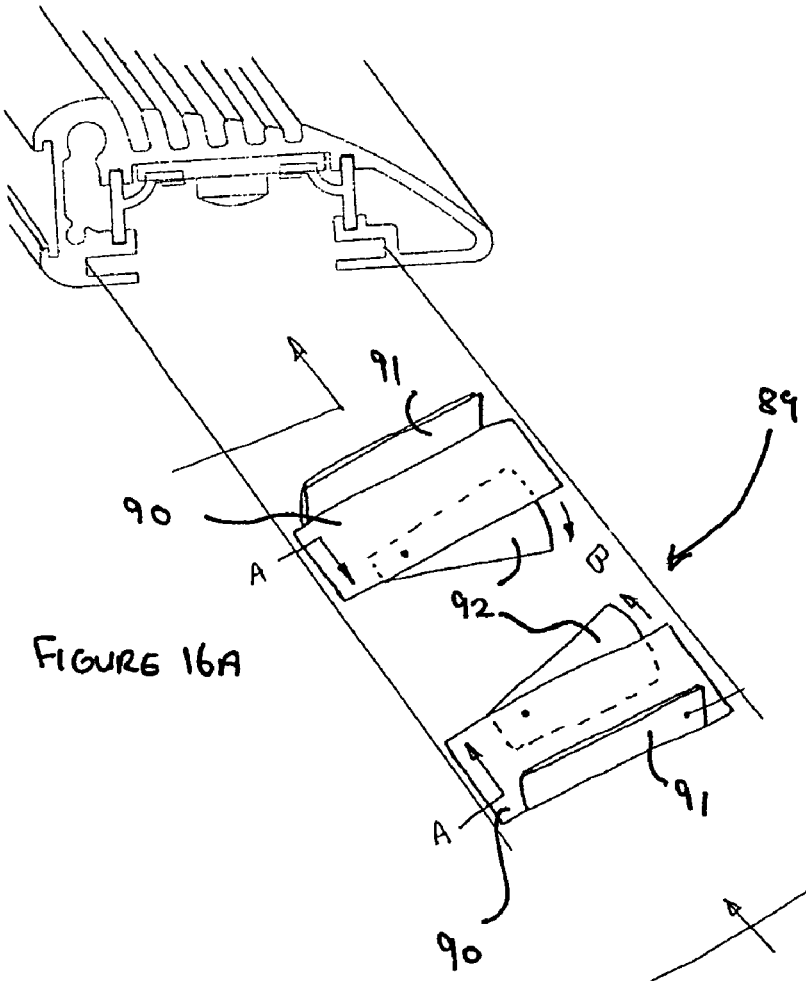
FIGS. 16A and 16B shows a further modification in which a plastic or metal plate having pivotable/slideable baffles or, an adjustable aperture is provided to enable to the height and the width of the beam of light to be controlled.

Referring to FIG. 16A, an adjustable light directing means 89 is shown. The adjustable light directing means 89 comprises a pair of mounting plates 90 with a flange 91 extending perpendicularly from one edge of each plate 90. Rotatably mounted to each plate proximate to the opposing edge of the plate 90 to the flange 91 is an arc-shaped shade section 92 which rotates laterally about a pivot mounted to the plate 90. As the plates are moved in the direction of arrow A, towards or away from each other, the width of the beam emitted by an LED positioned in the housing above the adjustable light directing means 89 is controlled. Furthermore, as the arc-shaped shade sections 92 are rotated, the vertical extent of the beam is altered. This enables the beam of light to be controlled so as to precisely illuminate the picture irrespective of its size.

Figure 16B:
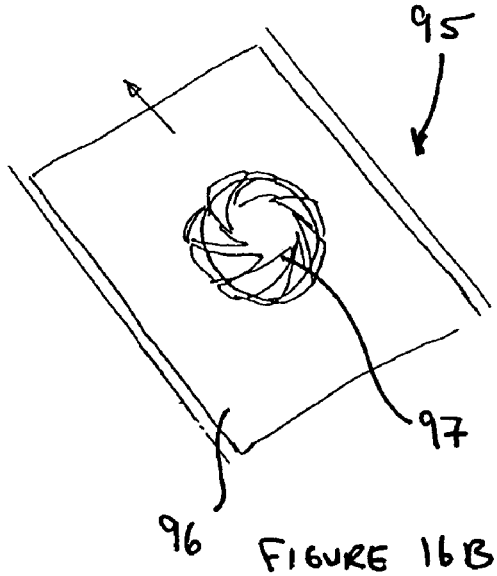

FIG. 16B shows an alternative adjustable light directing means 95 in the form of a plate 96 having an adjustable camera like shutter aperture 97 which enables the size of the opening to be adjusted without affecting its circular shape. This light directing means is applicable to the lighting of circular or oval paintings.

Operation of the light fixture 1 will now be described. When the light fixture 1 is to be mounted to illuminate a picture or the like (not shown) the elongate housing 5 is cut to the required length and the elongate resilient members 34 are cut to a corresponding length. The light is then assembled as discussed above such that the first and second resilient members 33, 34 are received in their respective slots 18. The required number of discrete LED assemblies are then slid into the channel 13 between the channel base 13*a* and the upper surface 42 of the second arm portion 39 of each resilient member 33, 34 such that the positive and negative terminals 30, 31 contact the foil strip 40 mounted on the first and second elongate resilient members 33, 34 respectively, or in an alternative embodiment wherein the resilient members 33, 34 are formed of a conductive material, the upper face 42 of the second arm portion 39. As the arms 36 are resilient, the LED mounting plates 25 are held securely in position. As well as a user sliding LED assemblies 23 along the channel 13 to their desired positions, it is possible to use one of the additional components that may be seated in the first slots 15 of the housing 5.

The diffuser 83 translucent plate may be seated in the laterally extending first slots 15 such that it extends substantially along the length of the housing 5. The edge portions 88 of the reflector 85 may alternatively be received in the first slots 15 of the housing 15 such that the reflector 85 is slidable along the channel 13 of the housing, together with a corresponding LED assembly 23 seated therein.

The remaining components of the light are then assembled as described above. Affixation of the light is achieved by mounting the brackets 4 to a picture frame or wall (not shown) by means of screws through the screw holes 79 and power is supplied by means of connecting the transformer 80 to a power supply (not shown). As the second end portions 57 of the arms 2, 3 are rotatable about the brackets 4 and the housing 5 mounted to the end caps 6, 7 is rotatable about the first end portions 56 of the arms 2, 3 it is possible for a user to orientate the light into a desired position. The O-rings 58 disposed on the first end portions 56 of the arms which are located in the cylindrical recesses 52 of the end caps 6, 7 provide a resistance to prevent rotation of the elongate housing 5 relative to the arms 2, 3. However, it will be appreciated that, instead of O-rings, the arms may include a pin that locates in elongate grooves in the recesses so that the arm will rotate but will be held in position.

Figure 8:
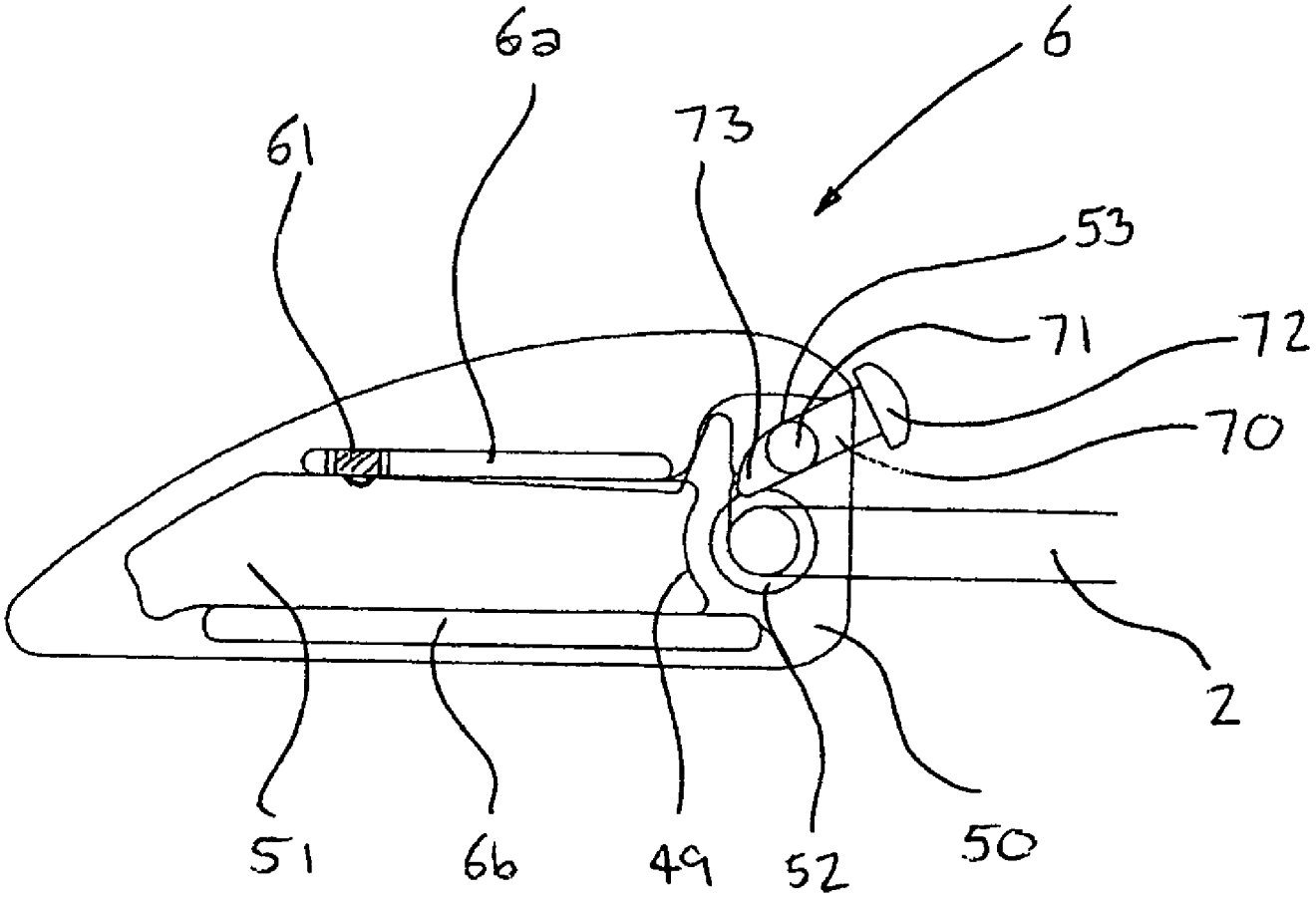
FIG. 8 is an inner end view of a first end cap of the light shown in FIG. 1 with a light switch in an 'on' position.
Figure 9:
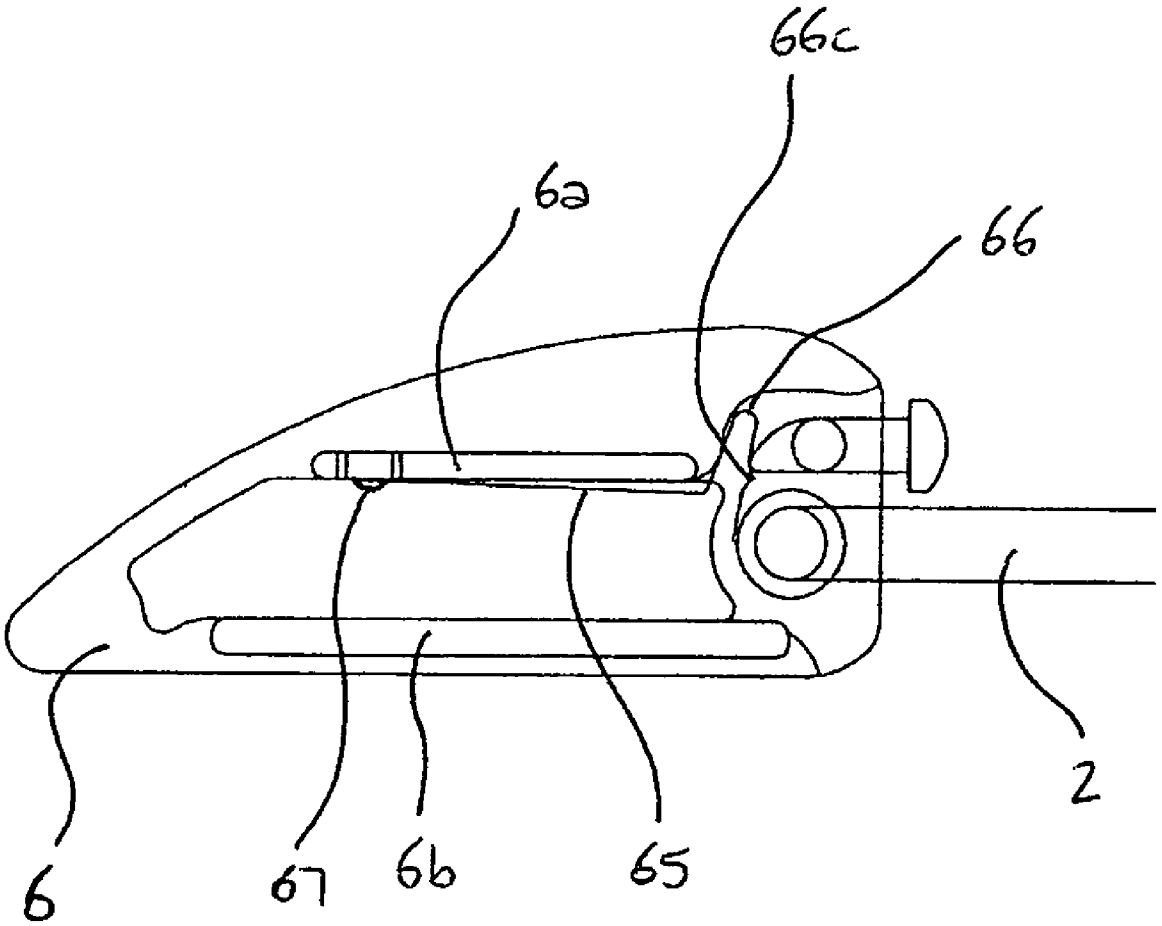
FIG. 9 is the end view of FIG. 8 but with the light switch in an 'off' position.
Figure 10:
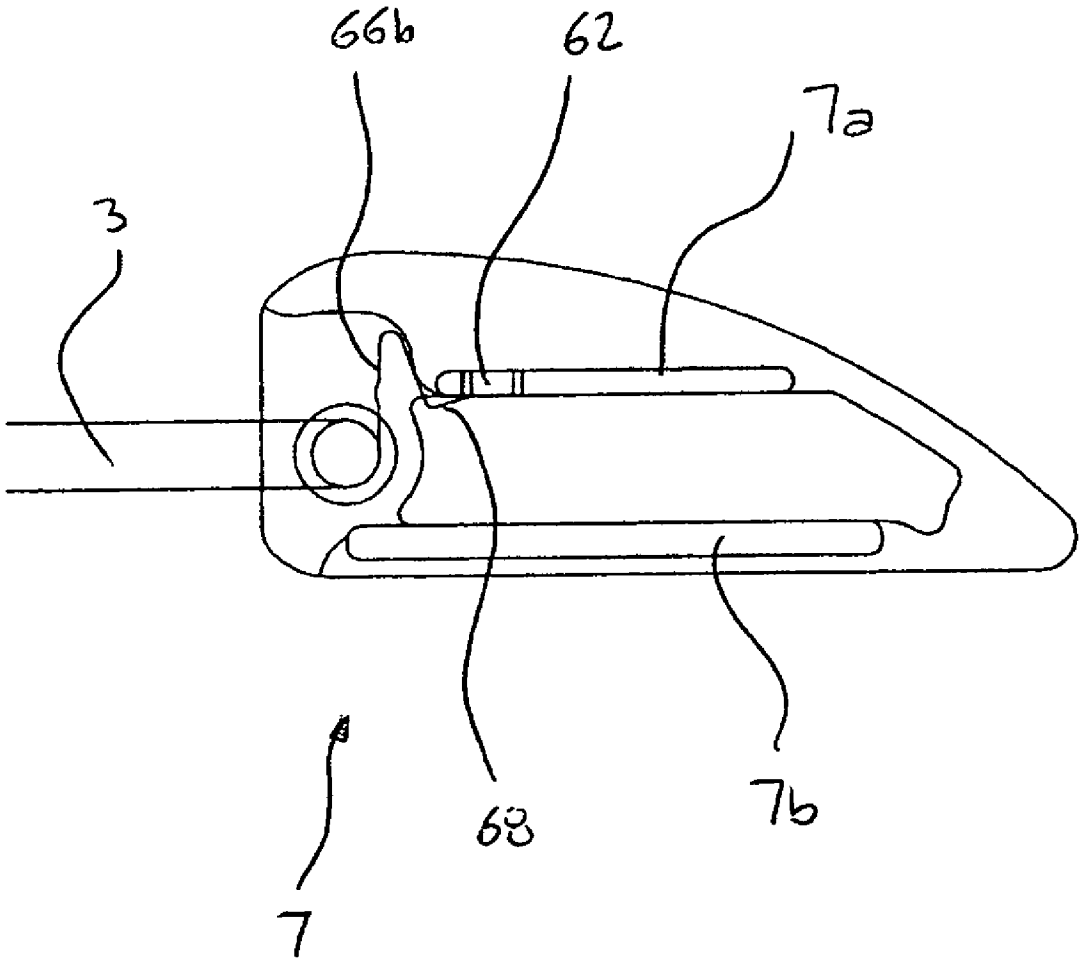
FIG. 10 is an end view of the other end cap of the light fixture shown in FIG. 1.

When the switch 69 is rotated in the small cylindrical recess 53 relative to the housing 5 in an 'off' position (as shown in FIG. 9) such that the shoulder 72 is rotated downwards, the second length 66*b* of the spring portion 66 of the first conductive track 61 is orientated away from the first arm 2 and contact between the conductive track 61 and the arm 2 is broken. The notch 66*c* on the second length 66*b* prevents the switch 69 from being rotated into an 'on' position (as shown in FIG. 8) due to the action of the spring portion 66. If a user rotates the switch 69 such that the shoulder 72 rotates downwards over the notch 66*c* then the second length 66*b* is forced outwards due to the resilience of the spring portion 66 and contacts the first arm 2.

The electrical circuit is then complete and so the LED 24 is illuminated. As the second length 66*b* of each conductive track 61, 62 is resiliently biased towards the arms 2, 3 then contact is retained therebetween as the housing 5 and end caps 6, 7 are rotated relative to the arms 2, 3. Furthermore, because each discrete LED assembly is slidable along the housing 5 between the between the channel base 13*a* and the upper face 42 of the resilient member arms 36 then each LED assembly 23 may be repositioned along the housing 5 during use of the light fixture 1. As the foil strip 40 or upper face 42 of the resilient member arms 36 runs along the length of the housing then contact with the electrical terminals 29, 30 is retained. Additionally, sides 28*a*, 28*b* are located relative to the channel sides 13*b*, 13*c* such that the LED mounting plate is constrained from rotating in the channel 13 and so the terminal portions 30, 31 remain in contact.

Removal of heat generated by the LED is aided by the housing. Heat is conducted through the LED mounting plate 25 from the LED 24 to the channel base portion 13*a* with which it is in contact. The fins 23 on the upper face 10 of the housing 5 act as a heat sink to disperse heat generated by the LED(s) and conducted through the thin wall of the housing 5 thereto to the surrounding air.

If the housing 5 requires additional support than that supplied by the arms 2, 3 then additional arms (not shown) may be mounted in the rear recess slots 18.

Although embodiments of the invention have been shown and described, it will be appreciated by those skilled in the art that these are preferred embodiments only and that variations may be made to the above exemplary embodiments that lie within the scope of the invention, as defined in the claims hereafter.

What is claimed is:

1. A housing for a light fixture, comprising:

an elongate body with a channel having a base to define a light emitting diode (LED) supporting surface and a pair of parallel slots in the channel on opposite sides of the LED supporting surface, each slot having a respective resilient member removably received therein which extends longitudinally along the body, each elongate resilient member being mounted in the body to retain at least one LED between the resilient member and the housing such that the at least one LED is able to be repositioned within the housing, and each resilient member having an electrically conductive rail so as to contact electrical terminals on the at least one LED to supply power thereto.

2. A housing according to claim 1, wherein the resilient member is configured so that the at least one LED held against the supporting surface is able to independently slide along the supporting surface.

3. A housing according to claim 1 , wherein the rails in respective slots are parallel and spaced from each other.

4. A housing according to claim 1 , wherein each resilient member has a base portion slidably received in said slot and, an arm extending into said channel and towards the LED supporting surface from said base.

5. A housing according to claim 4, wherein the arm of each resilient member is configured so that, when at least one LED is positioned on the LED supporting surface, the arm is resiliently deformed by the at least one LED to hold said LED against said LED supporting surface.

6. A housing according to claim 1, wherein the elongate body has a uniform cross-section so that the elongate body is able to be cut to any desired length prior to use.

7. A housing according to claim 1, comprising a pair of end caps attached to each end of the elongate body.

8. A housing according to claim 7, wherein at least one end cap is removably received so that at least one LED is able to be slid into the channel between the resilient members and the LED supporting surface, or removed therefrom.

9. A housing according to claim 1, comprising a plurality of fins formed on the housing to dissipate heat generated by the at least one LED.

10. A housing according to claim 3, comprising a pair of electrically conductive arms to support the housing and supply power to the resilient members in contact with the LEDs.

11. A housing according to claim 10, comprising a switch mechanism including a pair of conductive tracks disposed in one end cap having one end resiliently biased towards the arm, and lying in contact with the conductive rails at the other.

12. A housing according to claim 11, wherein the switching mechanism includes a switch member configured to urge one of said resilient tracks out of contact with the arm to break the electrical contact between said resilient track and arm when the switch member is operated.

13. A housing according to claim 1, further comprising a diffuser slidably mounted in the body to diffuse light generated by the at least one LED.

14. A housing according to claim 1, comprising a reflector associated with each LED and received in the channel to reflect light generated by the at least one LED.

15. A housing according to claim 1, wherein the at least one LED is held against the LED supporting surface by the resilient member.

16. A light according to claim 15, comprising a plurality of LEDs held against the LED supporting surface by the resilient member, each LED being discrete and configured to move independently relative to each of the remaining LEDs.

17. A light according to claim 15, wherein the at least one LED comprises a light emitting portion and a supporting plate, the resilient members acting against the supporting plate to retain the LED against the LED supporting surface.

18. A light according to claim 17, wherein the at least one LED has electrical terminals formed on the supporting plate and the resilient members are configured so that the at least one LED lies in contact with said electrical terminals when said LEDs are positioned against the LED supporting surface.

19. A housing for a light fixture, comprising:

an elongate body with a channel having a base to define an LED supporting surface, the resilient member being configured so that the at least one LED is held against the supporting surface by the resilient member;

an elongate resilient member extending longitudinally along the body, the elongate resilient member being mounted in the body to retain at least one light emitting diode (LED) between the resilient member and the housing such that the at least one LED is able to be repositioned within the housing;

a pair of slots in the channel on opposite sides of the LED supporting surface and each slot has a respective resilient member removably received therein, wherein each resilient member comprises a rail, and wherein the rails in respective slots are parallel and spaced from each other; and a pair of electrically conductive arms to support the housing and supply power to the resilient members in contact with the LEDs.

* * * * *